US006910655B2

(12) United States Patent
Fujioka

(10) Patent No.: US 6,910,655 B2
(45) Date of Patent: Jun. 28, 2005

(54) ROLL SHAFT, RECORDING MEDIUM SUPPLY APPARATUS AND RECORDING APPARATUS

(75) Inventor: Satoshi Fujioka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 11 days.

(21) Appl. No.: 10/637,042

(22) Filed: Aug. 8, 2003

(65) Prior Publication Data

US 2004/0104295 A1 Jun. 3, 2004

(30) Foreign Application Priority Data

Aug. 9, 2002 (JP) ..... P2002-232464

(51) Int. Cl.[7] ..... B65H 16/06; B65H 16/10
(52) U.S. Cl. ..... 242/545.1; 242/394.1
(58) Field of Search ..... 242/564, 545.1, 242/394.1

(56) References Cited

U.S. PATENT DOCUMENTS 4,085,671 A * 4/1978 Gates et al. ..... 101/128.1
6,422,502 B1 * 7/2002 Takada et al. ..... 242/543
6,435,446 B1 * 8/2002 Matsuzawa ..... 242/422.4

* cited by examiner

*Primary Examiner*—Kathy Matecki
*Assistant Examiner*—Sang Kim
(74) *Attorney, Agent, or Firm*—Sughrue Mion, PLLC

(57) ABSTRACT

A roll shaft comprises: a latching portion which is mounted outside of one end of a roll shaft body and latched to the bearing portion of the latching portion; a one-way connection portion which is mounted inside the one end of the roll shaft body and rotated in only a direction opposite to the direction of feeding in the recording medium with respect to the latching portion; and a torque transmission limiting portion which is mounted inside the one end of the roll shaft body, used to release the transmission of torque when the value of the torque applied to the roll shaft body is equal to or greater than a predetermined value at the time of feeding in the recording medium and used to allow the torque to be transmitted when the value of the torque is less than the predetermined value.

7 Claims, 10 Drawing Sheets

ROLL SHAFT, RECORDING MEDIUM SUPPLY APPARATUS AND RECORDING APPARATUS

The present application is based on Japanese Patent Application No. 2002-232464, the entire contents of which are incorporated herein by reference.

BACKGROUND OF THE INVENTION

1. Field of the Invention

The present invention relates to a roll shaft for supporting a recording medium rolled up on the roll shaft, a recording medium supply apparatus for supplying the recording medium and a recording apparatus for recording characters on the recording medium.

2. Related Art

Rolled paper prepared by winding printing paper in the form of a roll is loaded onto a roll shaft before being mounted in the paper feeding unit of a printer. Then the rolled paper together with the roll shaft is rotated at the time printing is done and let out, whereby the rolled paper is fed off toward the recording head side. The feeding of the rolled paper, that is, the rotation of the roll shaft is made such that a paper feeding roller disposed on the downstream side of the paper feeding unit carries the rolled paper while pressure-holding the forward end of the rolled paper. Therefore, the roll shaft is unable to stop rotating because of inertia and continues to rotate for a while immediately after the paper feeding roller stops rotating, thus causing the feeding of the rolled paper to stop. The rolled paper is let out toward the paper feeding roller even after the paper feeding roller stops rotating and warped in between the paper feeding unit and the paper feeding roller.

The warp results in causing the rolled paper to produce an unfavorable curl, an undesirable crease and the like. When the feeding of the rolled paper is started by rotating the paper feeding roller again with the warp left, the warped portion is fed in first and then the rolled paper is fed in by starting the rotation of the roll shaft. However, a sudden change (surging) in the carrying resistance occurs and there is the possibility of causing an error in conveyance by the paper feeding roller. The unfavorable curl and the undesirable crease and the like and the error in the conveyance caused by the paper feeding roller badly affect printing quality.

Therefore, there has been proposed an arrangement to provide a torque limiter for controlling the rotation of a roll shaft. With this arrangement, the roll shaft is rotated so as to feed in rolled paper only in case where torque at a predetermined level or higher is applied by a paper feeding roller and the roll shaft is quickly stopped with the paper feeding roller stopped, so that the rolled paper is prevented from producing a warp. Moreover, the whole rolled paper is braked during the time the rolled paper is being fed in and because driving operation follows up the roll shaft of a braking source, the skew of the rolled paper can be suppressed.

When thin rolled paper is used, however, the rolled paper is only restrained longitudinally in the space between the roll shaft and the paper feeding roller and likely to produce creases because the rolled paper is free from any restraint in the lateral direction. Therefore, creases are prevented from being produced by sharply increasing the torque of the torque limiter to longitudinally pull the rolled paper as much as possible whereby to restrain such moving freedom in the lateral direction.

When the torque of the torque limiter exceeds the own weight of the rolled paper, the rolled paper is lifted up together with the roll shaft during the operation of manually rewinding the rolled paper after the rolled paper is set in the paper feeding unit and this brings about a so-called cog misalignment phenomenon in which the gears joined together on one side of the roll shaft are off its meshing, thus causing the roll shaft to rotate. Consequently, the rolled paper set straight becomes tilted and the problem in this case is that the rolled paper makes an oblique movement (skew).

SUMMARY OF THE INVENTION

An object of the invention made in view of the foregoing problem is to provide a roll shaft which is used for supporting rolled recording medium and capable of preventing a cog misalignment phenomenon, a recording medium supply apparatus for supplying the recording medium and a recording apparatus for recording characters on the recording medium.

(1) In order to accomplish the object above, according to the invention, a roll shaft which is inserted through the core of a rolled recording medium, hung in the bearing portion of a recording medium supply apparatus and rotated together with the recording medium whereby to feed in the recording medium, comprises; a latching portion which is mounted outside of one end of a roll shaft body and latched to the bearing portion thereof; a one-way connection portion which is mounted inside of the one end of the roll shaft body and rotated with respect to the latching portion in only a direction opposite to the direction of feeding in the recording medium; and a torque transmission limiting portion which is mounted inside of the one end of the roll shaft body, wherein the torque transmission limiting portion releases the transmission of torque if the torque applied to the roll shaft body is not less than a predetermined value and transmits the torque if the value of the torque is less than the predetermined value when the recording medium is fed.

When torque at the predetermined value or larger is applied to the roll shaft body at the time the rolled recording medium is carried, the torque is released by the torque transmission limiting portion from being transmitted to the one-way connection portion. In this case, the latching portion is latched to the bearing portion provided in the recording medium supply apparatus so that the latching portion is made unrotatable. As the one-way connection portion is made unrotatable in the direction of carrying the rolled recording medium, only the roll shaft body is rotated according to the torque and the rolled recording medium is fed in. Consequently, the rolled recording medium is prevented from making an oblique movement and producing creases.

When the value of the torque applied to the roll shaft body comes to be smaller than the predetermined value as the rolled recording medium is stopped from being carried, the torque is transmitted by the torque transmission limiting portion to the one-way connection portion. Consequently, the rotation of the roll shaft body is braked by the latching portion and the one-way connection portion and quickly stopped. Therefore, the rolled recording medium can be prevented from warping. The rolled recording medium is thus readily wound manually because the roll shaft body can be subjected to free-load rotation by the one-way connection portion in a direction opposite to the direction of feeding in the rolled recording medium to ensure that the cog misalignment phenomenon of the roll shaft is prevented.

(2) According to the invention, the roll shaft is such that the outer diameter of the latching portion is smaller than the inner diameter of the core of the rolled recording medium. Thus the rolled recording medium is mountable by passing the roll shaft body through the rolled recording medium even from the side where the latching portion is provided.

(3) According to the invention, the roll shaft is such that the outer diameter of the latching portion is substantially equal to the outer diameter of the roll shaft body. Thus even though the inner diameter of a fixing member for fixing the rolled recording medium to the roll shaft body is substantially equal to the outer diameter of the roll shaft body, the fixing member is mountable onto the roll shaft body from the latching portion side.

(4) According to the invention, the roll shaft is such that the latching portion and the torque transmission limiting portion are provided on the side of one end portion, out of both the end portions of the roll shaft body, where the roll shaft body is inserted in and passed through the core of the rolled recording medium and wherein an abutment member for abutting the rolled recording medium is provided on the side of the other end portion of the roll shaft body. Thus the concentration of the weight on the one-side end portion of the roll shaft is avoided and the weight balance between both the end portions of the roll shaft is maintainable, whereby the rolled recording medium can be supplied with stability.

(5) According to the invention, the roll shaft is such that wherein the latching portion has one or more than one projection in the circumferential direction, the projection being latched to the bearing portion. Thus the rotation of the latching portion is prevented even during the time the roll shaft body together with the rolled recording medium rotates so as to feed in the recording medium.

(6) In order to accomplish the object above, according to the invention, a recording medium supply apparatus for supplying a rolled recording medium is such that the roll shaft can be mounted therein. Thus the recording medium supply apparatus capable of achieving the operation/working effect as described above can be provided.

(7) In order to accomplish the object above, according to the invention, a recording apparatus for recording characters on a rolled recording medium has the recording medium supply apparatus. Thus the recording apparatus capable of achieving the operation/working effect as described above can be provided.

DETAILED DESCRIPTION OF THE PREFERRED EMBODIMENTS

Figure 1:
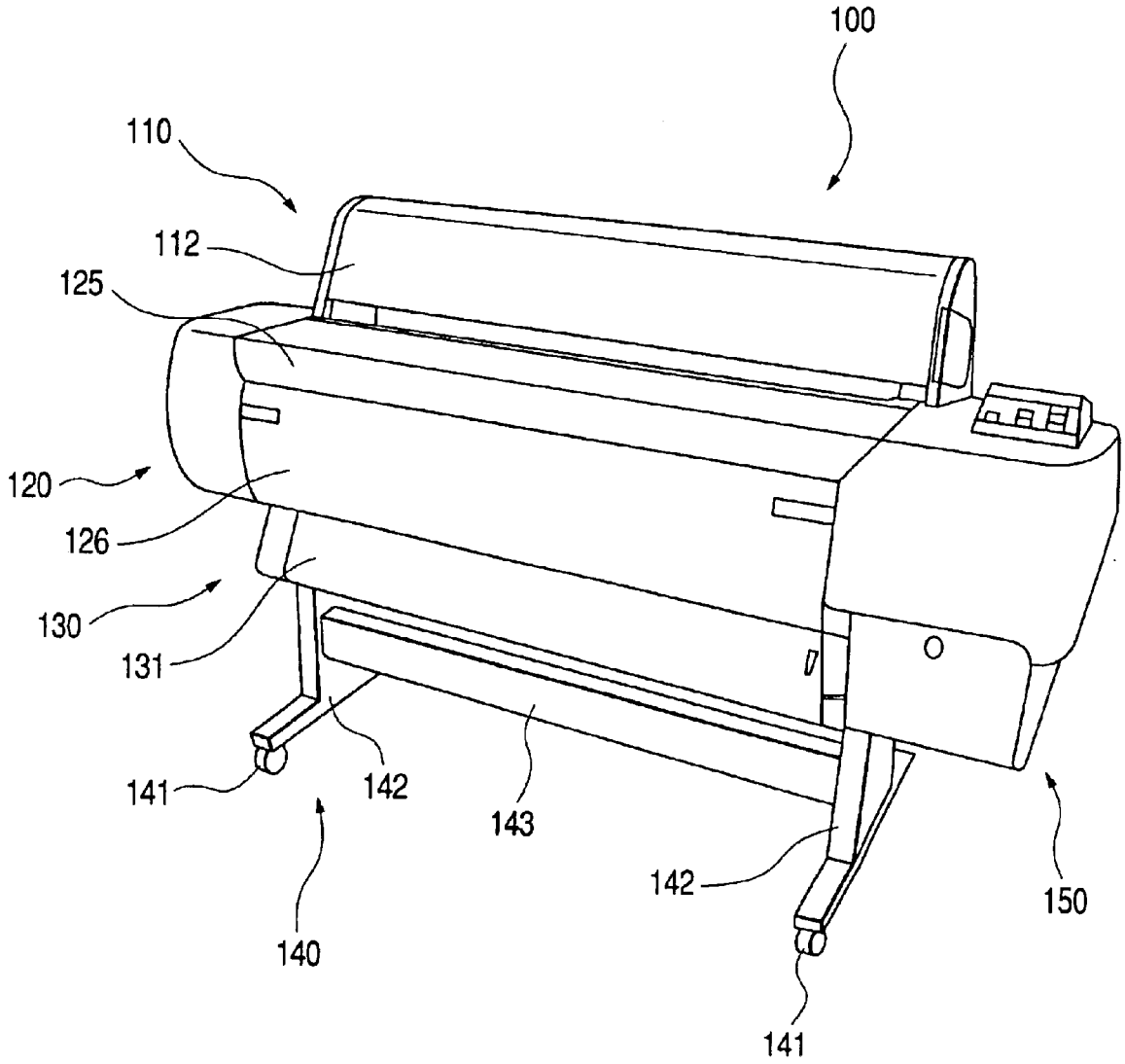
FIG. 1 is a perspective view of an ink-jet printer as one of the recording apparatus, showing its exemplary construction according to the embodiment of the invention.
Figure 2:
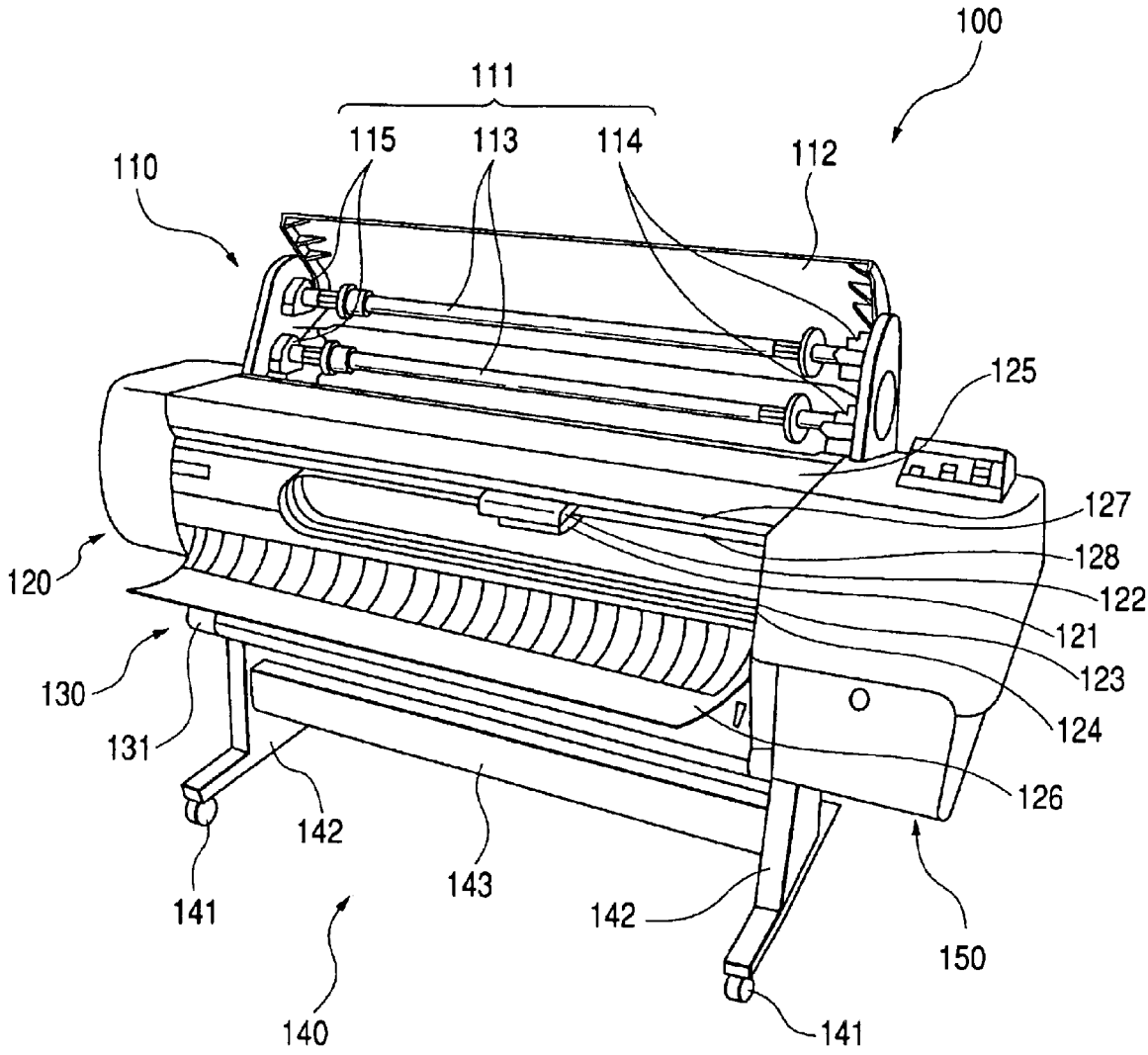
FIG. 2 is a perspective view of the ink-jet printer showing the inner construction of its principal portion of the printer of FIG. 1.

An embodiment of the invention will now be described in detail with reference to the drawings. FIG. 1 is a perspective view of an ink-jet printer as one of the recording apparatus, showing its construction by way of example according to the embodiment of the invention; and FIG. 2, a perspective view of the ink-jet printer showing the principal portion of the inner construction. The ink-jet printer 100 shown in FIG. 1 and FIG. 2 is a large-sized printer capable of printing characters on printing paper of relatively large size including A1 and B1 according to the Japanese Industrial Standards. In this ink-jet printer 100, a paper feeding unit (a recording medium supply apparatus) 110, a printing unit 120, a discharging unit 130 and a leg portion 140 are disposed in this order from the top thereof. The printing unit 120 and the discharging unit 130 are formed integrally with the printer body, whereas the paper feeding unit 110 and the leg portion 140 are formed detachably.

As shown in FIG. 1, the paper feeding unit 110 is provided so as to project upward from the rear of the upper portions of the bodies 120 and 130. As shown in FIG. 2, further, a rolled paper holder 11 in which two rolls of paper can be set is provided vertically and diagonally and as shown in FIG. 1 and FIG. 2 a rolled paper cover 112 that can be opened and closed like a trap door is fitted to the front of the paper feeding unit 110 to cover up the rolled paper holder 111.

As shown in FIG. 2, the rolled paper holder 111 has spindles (roll shafts) 113 for holding rolled paper and a pair of spindle receivers (bearing portions) 114 and 115 that are attached onto both the respective inner wall surfaces of the paper feeding unit 110 and used for attaching, detaching and hanging the spindles 113. As shown in FIG. 1 and FIG. 2, the rolled paper cover 112 is supported so that its upper portion is rotatable, the rolled paper cover 112 being opened or closed by holding up or holding down the lower portion.

Figure 3:
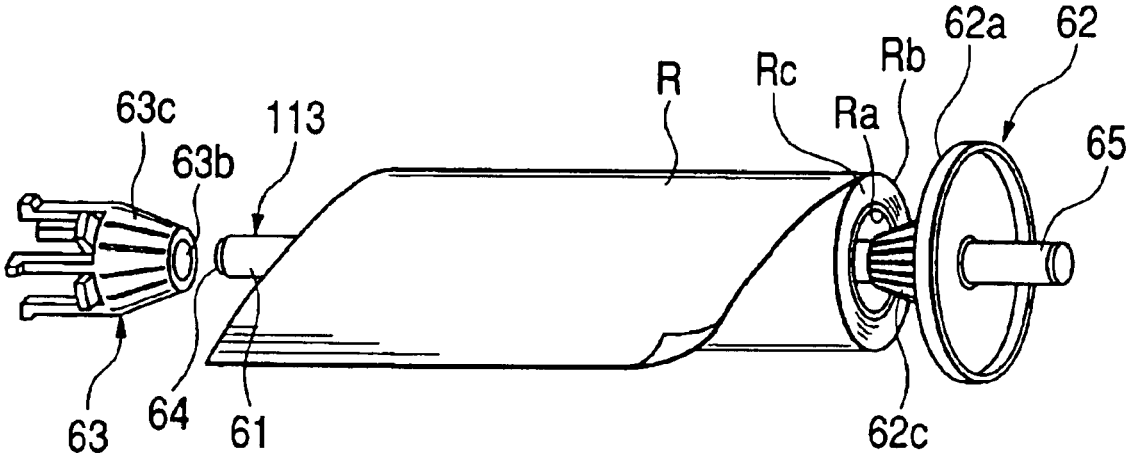
FIG. 3 is a perspective view showing a condition where rolled paper is attached to the spindle of the printer of FIG. 1.

FIG. 3 is a perspective view showing a condition where rolled paper R is attached to the spindle 113. The columnar spindle 113 as a hollow body has a spindle body (roll shaft body) 61 loaded with the rolled paper R, an end portion cover (a latching portion) 64 and an end portion cover 65, both of which are attached to the respective end portions of the spindle body 61. The end portion covers 64 and 65 have substantially the same diameter as that of the spindle body 61. The end portion of the spindle 113 on the side of the end portion cover 65 is mounted in the spindle receiver 114 and the end portion of thereof on the side of the end portion cover 64 is mounted in the spindle receiver 115, the spindle 113 being hung between the spindle receivers 114 and 115.

An abutment member (fixed paper stopper) 62 is provided in a fixed condition near the end portion cover 65 of the spindle body 61. The abutment member 62 is discal in shape and has a diameter set greater than that of the rolled paper R thus attached. The inner edge face (discal face) 62*a* of the abutment member 62 is formed as a contacting face that the side edge face Rc of the rolled paper R is brought into contact with.

A rolled paper core receiving portion 62*c* projected toward the central portion of the spindle 113 is formed integrally with the contacting face 62*a* of the abutment member 62. The rolled paper core receiving portion 62*c* is bent inward in the radial direction and arranged so that it is pressed in the core Ra of the rolled paper R. Thus the rolled paper core receiving portion 62*c* functions as a fixing member for fixing the rolled paper R to the spindle body 61 and rotating the rolled paper R together with the spindle 113.

A fixing member (movable paper stopper) 63 for rotating the rolled paper R together with the spindle 113 is fixedly fitted in near the end portion cover 64 of the spindle body 61 after the rolled paper R is loaded. A projected rolled paper core receiving portion 63*c* is formed integrally with the fixing member 63 and a hole 63*b* that passes through the rolled paper core receiving portion 63*c* and makes the spindle body 61 pass therethrough is formed in the rolled paper core receiving portion 63*c*. The inner diameter of the hole 63*b* is set substantially equal to the outer diameter of the spindle body 61.

The fixing member 63 is mated with the spindle body 61 so that the rolled paper core receiving portion 63*c* is directed to the central portion of the spindle 113. The rolled paper core receiving portion is bent inward in the radial direction and pressed in the core Ra of the rolled paper R. Thus the rolled paper core receiving portion 63*c* functions so as to fix the rolled paper R to the spindle body 61 and to integrate the rolled paper R with the spindle 113 whereby to rotate the rolled paper R together with the spindle 113.

Figure 4:
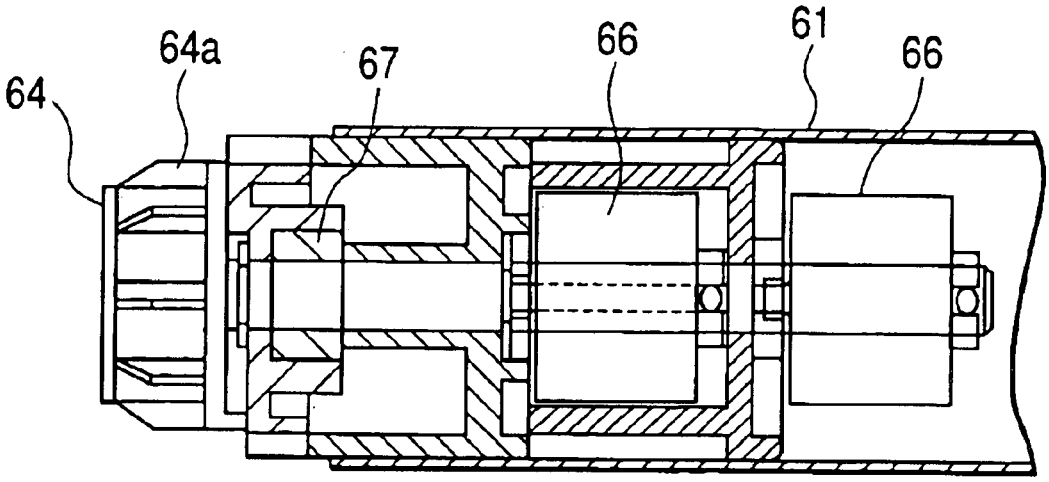
FIG. 4 is a transverse sectional view of the left end portion of the spindle of FIG. 3.

FIG. 4 is a transverse sectional view of the left end portion of the spindle 113 of FIG. 3. A plurality of rib-like projections 64*a* (eight projections according to this embodiment of the invention) are integrally formed in the circumferential direction and at least one rib-like projection 64*a* is fitted to the exterior of the left end of the spindle body 61 so that the rib-like projection latches onto the spindle receiver 115 and is made unrotatable. A one-way connection portion 67 is mounted inside the left end of the spindle body 61 so as to rotate in a direction opposite to the direction of feeding in the rolled paper R, that is, in only the paper-winding direction.

A torque transmission limiting portion 66 is mounted inside the left end of the spindle body 61 in order that the torque transmission limiting portion is independently rotated with the rotation of the spindle body 61 as the rolled paper R is fed into the printing unit and that the torque transmission limiting portion integrally with the one-way connection portion 67 is rotated as the spindle body 61 rotates with the winding of the rolled paper R carried out. The torque transmission limiting portion 66 operates to release the torque applied to the spindle body 61 from being transmitted to the one-way connection portion 67 when torque having a predetermined value or larger is applied to the spindle body 61, that is, to the torque transmission limiting portion 66 via the rolled paper R as a paper feeding roller carries the rolled paper R.

The predetermined value in this case means a torque value or smaller given by the paper feeding roller or a torque value without bringing about deterioration of printing quality resulting from the obstruction of conveyance of the rolled paper R in the subscanning direction caused by the paper feeding roller. Consequently, the spindle body 61 is made rotatable according to the torque applied to the one-way connection portion 67. In this case, the end portion cover 64 is prevented from rotating, by latching it onto the spindle receiver 115 and as the one-way connection portion 67 is not allowed to rotate in the direction of feeding in the rolled paper R, the torque transmission limiting portion 66 and the spindle body 61 only are rotated according to the torque applied, whereby the rolled paper R is fed into the printing unit. Therefore, the rolled paper R is prevented from being moved obliquely and crumpled.

When the value of the torque applied via the rolled paper R to the spindle body 61 comes to be smaller than the predetermined one with the paper feeding roller in a stopped condition, on the other hand, the torque transmission limiting portion 66 transmits the torque applied to the spindle body 61 to the one-way connection portion 67, whereby the rotation of the spindle body 61 is braked by the one-way connection portion 67 and end portion cover 64 and quickly stopped. Therefore, the rolled paper R is prevented from being warped. Then the rolled paper R can easily be wound manually because the spindle body 61 can be subjected to free-load rotation by the one-way connection portion 67 in a direction opposite to the direction of feeding in the rolled paper R to ensure that a cog misalignment phenomenon is prevented from occurring.

The specific configuration of the one-way connection portion 67 and the torque transmission limiting portion 66 is similar to that of a one-way clutch and a torque limiter that have been used so far. As the one-way connection portion 67 and the torque transmission limiting portion 66 are contained in the spindle body 61, the internal space of the spindle body 61 can be utilized effectively and complication of the external form of the spindle body 61 can also be avoided. The end portion cover 64, the one-way connection portion 67 and the torque transmission limiting portion 66 are provided in the end portion opposite to the end portion where the abutment member 62 is fixedly provided, whereby the concentration of the weight on one-side end portion of the spindle 113 is avoided and the weight balance between both the end portions of the spindle is maintainable. Thus the spindle 113 can be mounted in the paper feeding unit 110 with stability, so that stable paper feeding is carried out.

Figure 5:
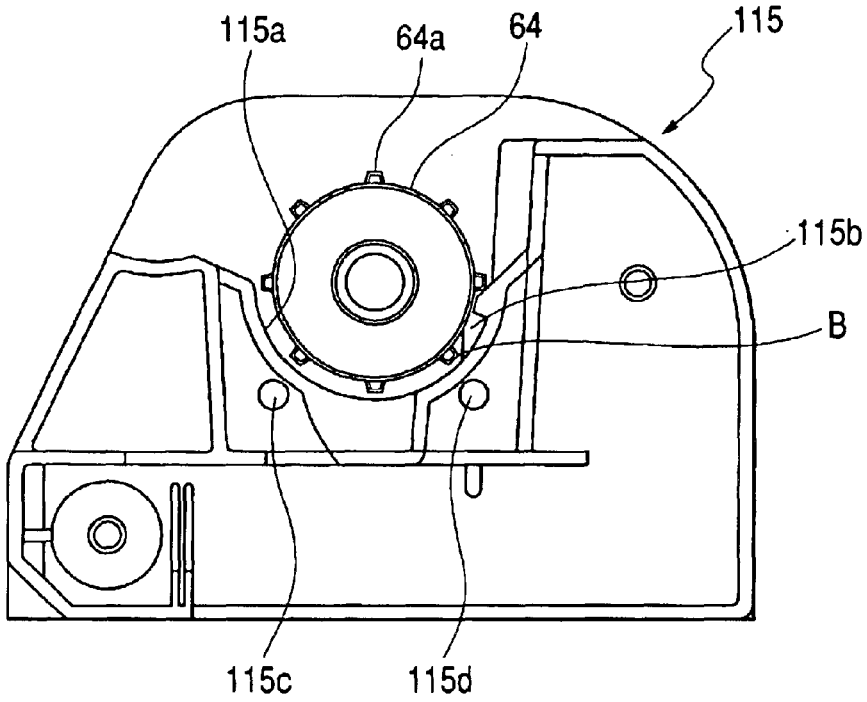
FIG. 5 is a right side view of the spindle receiver of the printer of FIG. 1.
Figure 6:
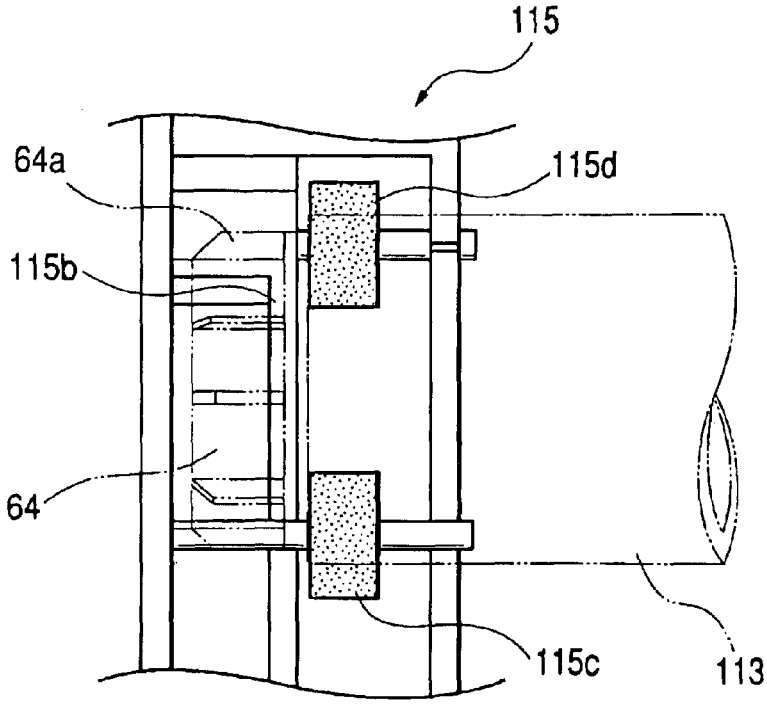
FIG. 6 is a top plan view of the spindle receiver of FIG. 5.

FIG. 5 is a right side view of the spindle receiver 115; and FIG. 6, a top plan view thereof. In FIG. 6, the spindle 113 fitted in the spindle receiver 115 is shown by an imaginary line. The spindle receiver 115 is formed integrally with an arcuate hollow portion 115*a* in which the end portion cover 64 is mounted and a projected portion 115*b* projecting toward the inner side of the hollow portion 115*a*.

In order to facilitate the rotation of the spindle body 61, two rollers 115*c* and 115*d* caused to rotate by following the rotation of the spindle body 61 are installed. The projected portion 115*b* is arranged so that any one of the rib-like projections 64*a* of the end portion cover 64 is latched, that is, caught at a contact point B in the rotating direction of the spindle body 61 at the time of feeding in paper, that is, in the counterclockwise direction of FIG. 5, whereby even when the spindle body 61 rotates, the end portion cover 64 is not allowed to rotate.

As shown in FIG. 2, the printing unit 120 has a carriage 122 for carrying a recording head 121, a flexible flat cable (hereinafter called the FFC) 123 for connecting the recording head 121 and a control unit (not shown) for doing printing, an ink tube 124 for connecting the recording head 121 and an ink cartridge (not shown) filled with ink, a paper feeding roller (not shown) for carrying the rolled paper in the subscanning direction, a paper sucking means (not shown) for preventing the rolled paper from floating up and so forth. As shown in FIG. 1 and FIG. 2, moreover, an upper cover 125 and a front cover 126 are respectively fitted to the upper side and the front side of the printing unit 120 so as to cover the recording head 121 and the carriage 122.

The recording head 121 includes a black ink recording head for discharging black ink and a plurality of recording heads for discharging yellow, light cyan, cyan, light magenta and magenta ink, for example. The recording head 121 further includes pressure generating chambers and nozzle openings coupled to the pressure generating chambers. The ink stored in the pressure generating chamber is pressurized at a predetermined pressure, so that ink droplets of controlled size are discharged from the nozzle openings toward the rolled paper.

As shown in FIG. 2, the carriage 122 is hung via a roller from a rail 127 provided in the main scanning direction and coupled to a carriage belt 128. When the carriage belt 128 is operated by a carriage drive (not shown), the carriage 122 is guided by the rail 127 so as to make a reciprocating motion in response to the movement of the carriage belt 128.

One end of the FFC 123 is connected to the connector of the control unit, the other end thereof being connected to the recording head 121, whereby printing signals are sent from the control unit to the recording head 121. Ink tubes 124 for different ink colors are arranged so that one end of each ink tube is coupled to a corresponding colored ink cartridge via a pressurized ink supply means (not shown) and the other end thereof is coupled to a corresponding colored ink head 121.

Then each ink tube 124 sends colored ink pressurized by the pressurized ink supply means from the ink cartridge to the recording head 121. The lower portion of the front cover 126 is as shown in FIG. 1 and FIG. 2 rotatably supported and the front cover 126 is opened or closed by holding up or holding down the lower portion.

The discharging unit 130 has as shown in FIG. 1 and FIG. 2 a feeder output guide 131 forming part of the passage for use in carrying the rolled paper in the subscanning direction and a feeder output roller (not shown) for carrying the rolled paper in the subscanning direction. As shown in FIG. 1 and FIG. 2, moreover, a cartridge holder 150 for containing and holding the ink cartridge is disposed on the right-hand side of the discharging unit 130 as seen from the front side of the discharging unit 130.

As shown in FIG. 1 and FIG. 2, the leg portion 140 has two support pillars 142 with moving casters 141 and a reinforcing bar 143 stretched between these support pillars 142. The paper feeding unit 110, the bodies 120 and 130 are mounted on the support pillars 142 and fixed with screws.

Figure 7:
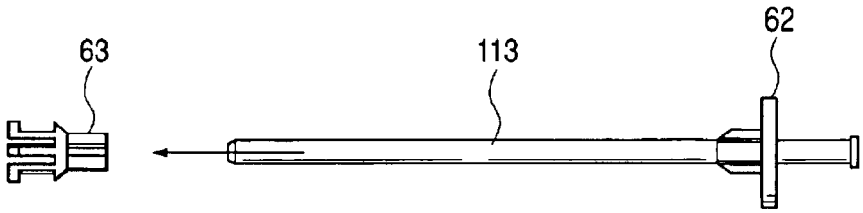
FIG. 7 is a first diagram showing a procedure for the use of the printer of FIG. 1.
Figure 8:
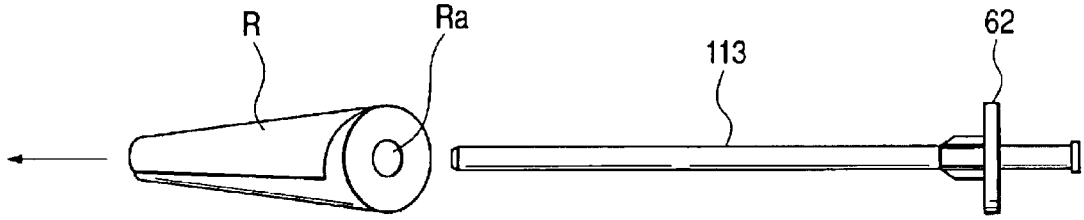
FIG. 8 is a second diagram showing the procedure for the use of the printer of FIG. 1.
Figure 9:
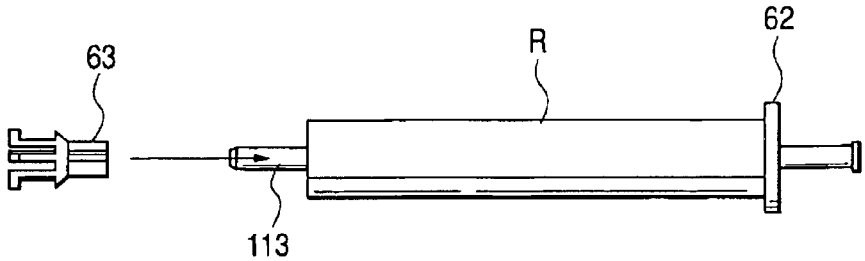
FIG. 9 is a third diagram showing the procedure for the use of the printer of FIG. 1;.

With the arrangement above, the spindle 113 used to constitute the rolled paper holder 111 is removed from the paper feeding unit 110 first when the ink-jet printer 100 is operated and the fixing member 63 mated with the spindle 113 is pulled out from one end of the spindle 113 as shown in FIG. 7. Then one end of the spindle 113 is inserted in from one end of the core Ra of the rolled paper R and passed therethrough as shown in FIG. 8 and one end of the core Ra of the rolled paper R is mated with the rolled paper core receiving portion 62*c* of the abutment member 62 fixedly mated with the other end of the spindle 113 and brought into contact with the contacting face 62*a* as shown in FIG. 9.

Then one end of the spindle 113 is loaded with the fixing member 63 so as to mate the rolled paper core receiving portion 63*c* of the fixing member 63 with the other end of the core Ra of the rolled paper R. Thus the rolled paper R together with the spindle 113 is made rotatable. Since the end portion cover 64 has an outer diameter substantially equal to that of the spindle body 61, the spindle 113 is readily insertable into the rolled paper R and the fixing member 63 from the side of the end portion cover 64.

Figure 10:
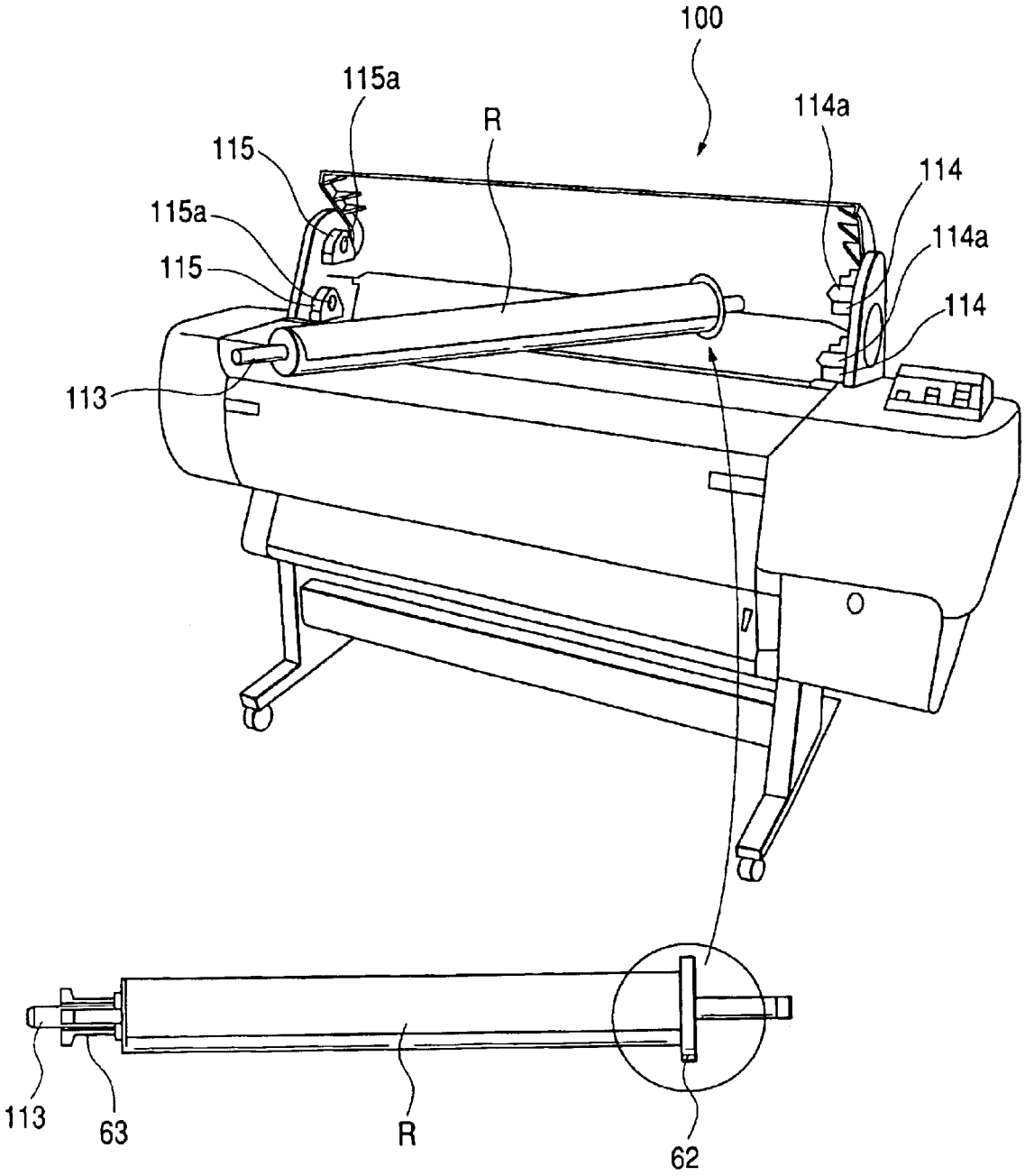
FIG. 10 is a fourth diagram showing the procedure for the use of the printer of FIG. 1.
Figure 11:
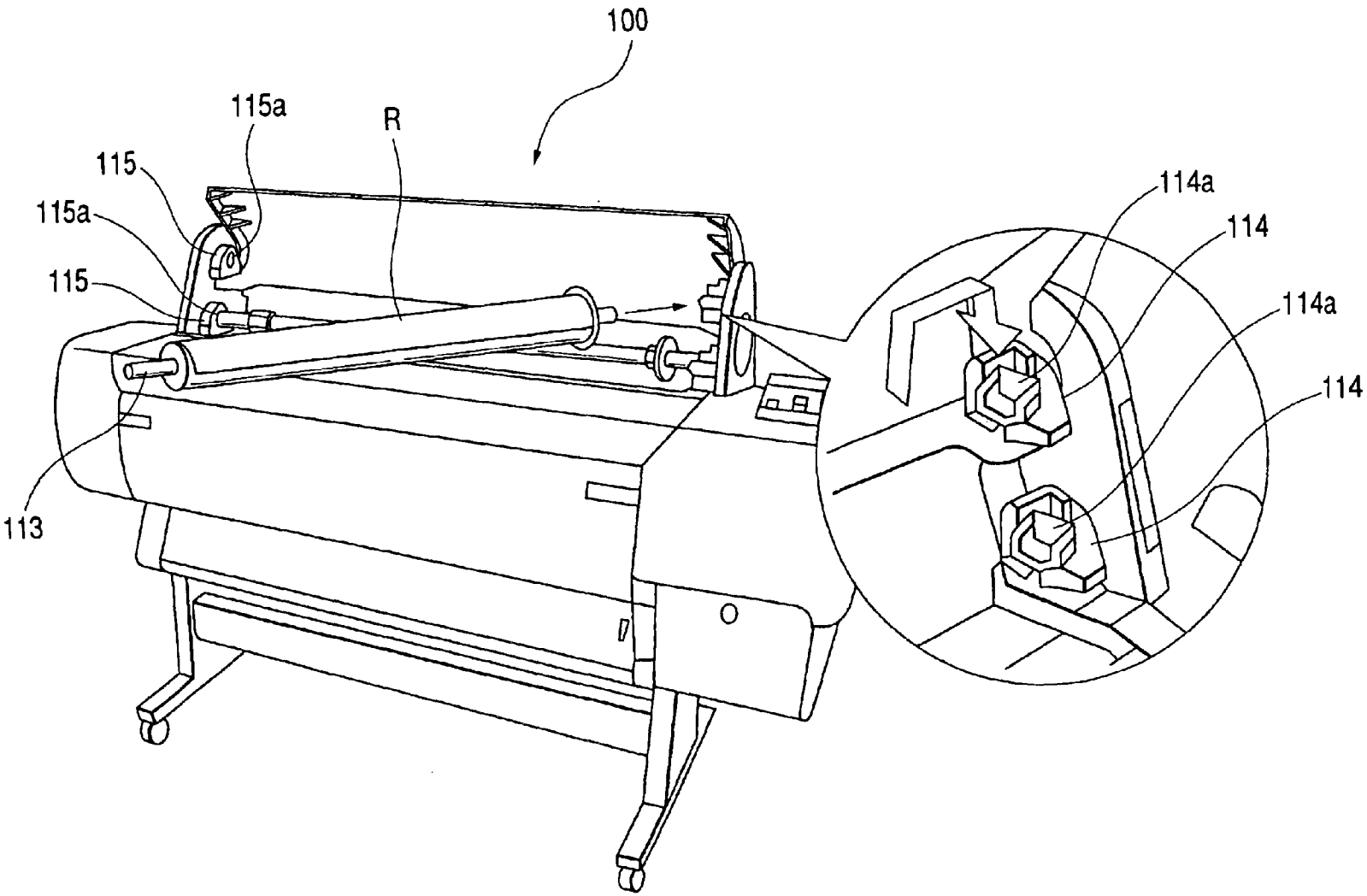
FIG. 11 is a fifth diagram showing the procedure for the use of the printer of FIG. 1.

As shown in FIG. 10, further, the spindle 113 is turned obliquely with respect to the longitudinal direction of the ink-jet printer 100 by holding both ends of the spindle 113 loaded with the rolled paper R, that is, the other end side of the spindle 113 loaded with the rolled paper R is directed to the spindle receiver 114 on one side. In this case, the spindle receiver 114 is arranged so as to be rotatable in the horizontal direction and though the hollow portions 114*a* and 115*a* of the spindle receivers 114 and 115 for receiving the end portions of the spindle 113 are normally kept opposite to each other, the spindle receiver 114 on one side is turned so as to have an angle of about 45 degrees with the spindle receiver 115 on the other side as shown in FIG. 11 when the spindle 113 loaded with the rolled paper R is set.

The other end portion of the spindle 113 loaded with the rolled paper R is hooked on the hollow portion 114*a* of the spindle receiver on one side and the spindle receiver 114 together with the spindle 113 loaded with the rolled paper R is rotated. Further, one end portion of the spindle 113 loaded with the rolled paper R is hooked on the hollow portion 15*a* of the spindle receiver 115 by making the hollow portions 114*a* and 115*a* of the spindle receivers 114 and 115 face each other. Thus the spindle 113 loaded with the rolled paper R can readily be set in the paper feeding unit 110.

Figure 12:
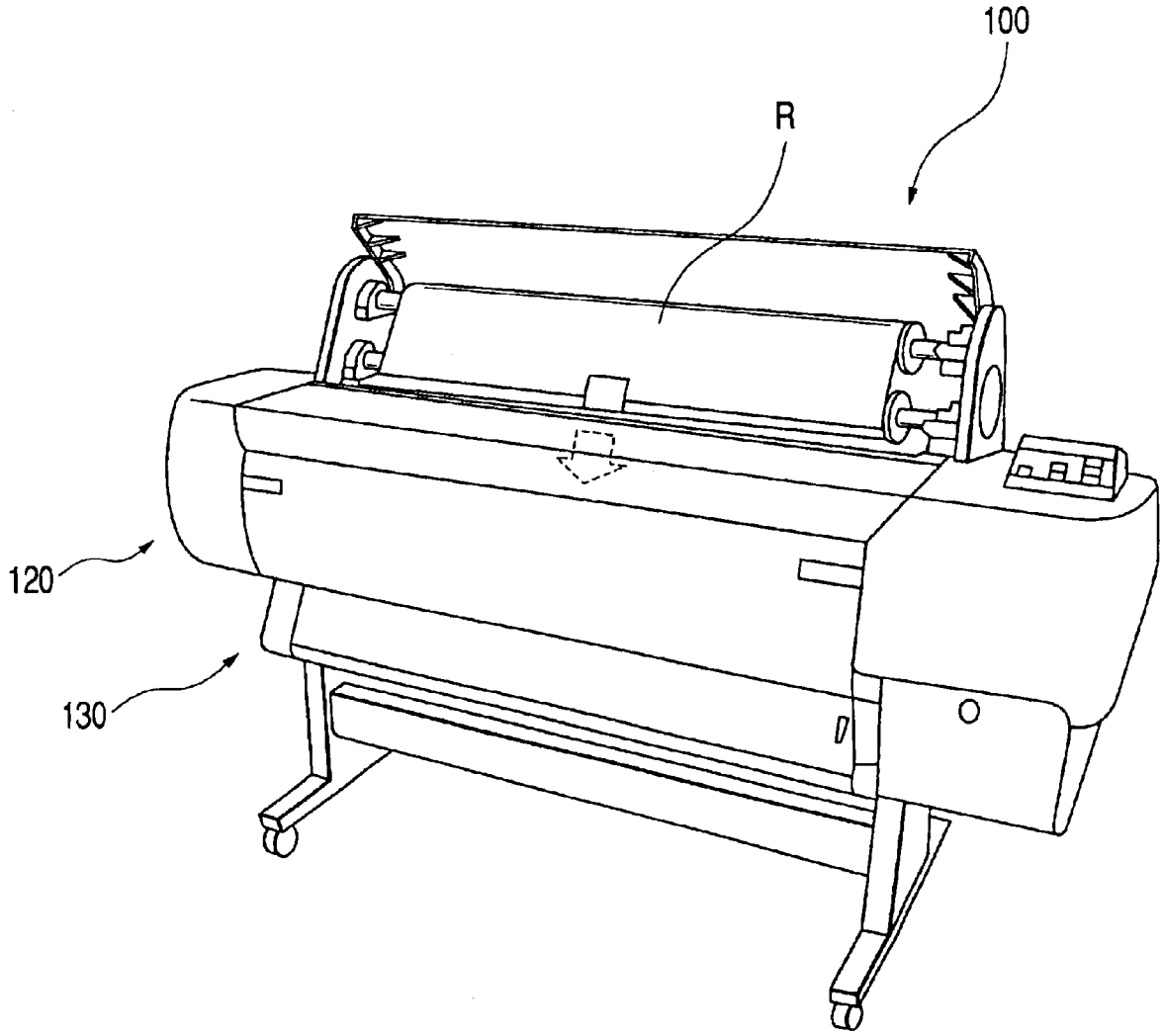
FIG. 12 is a sixth diagram showing the procedure for the use of the printer of FIG. 1.
Figure 13:
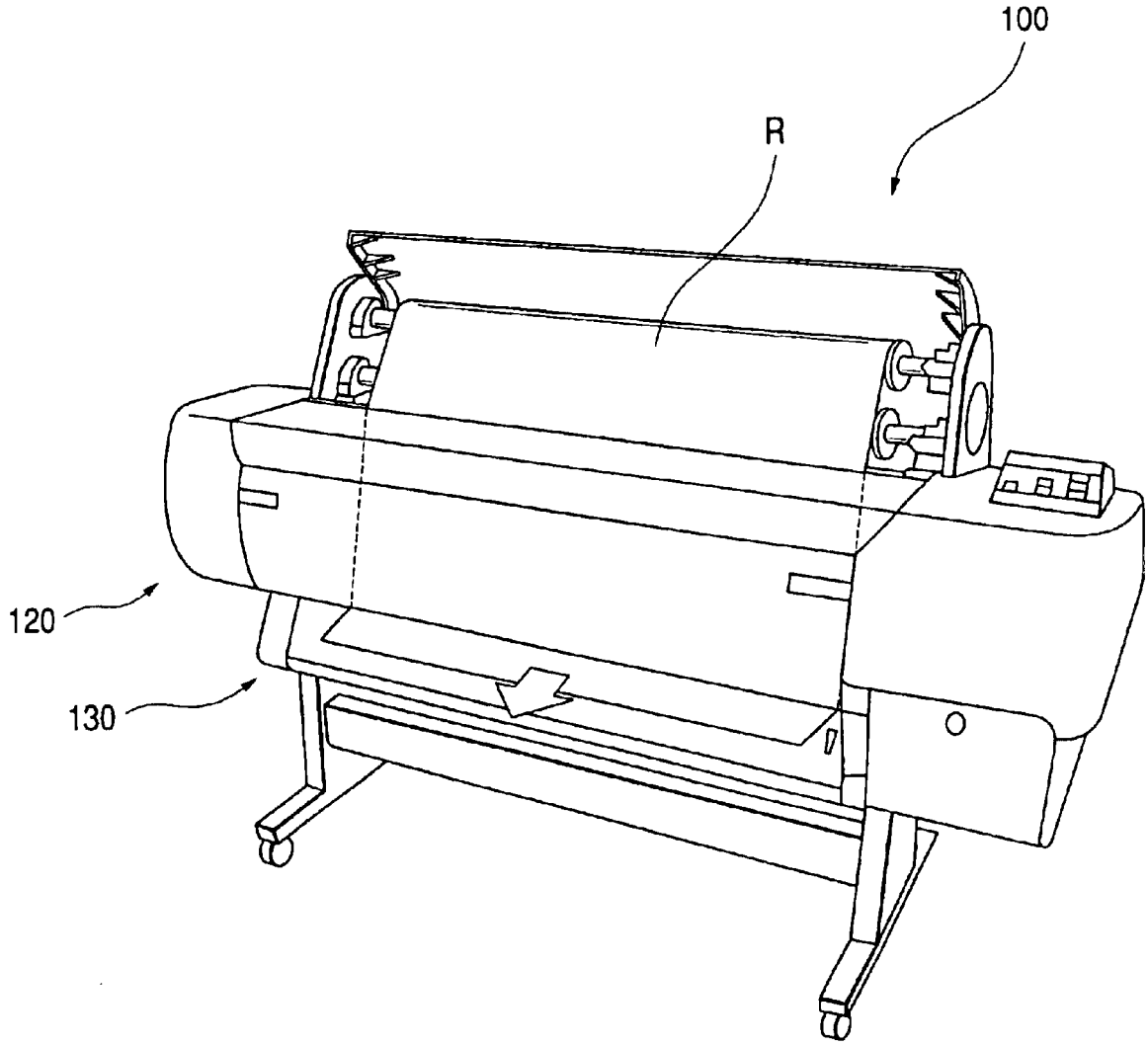
FIG. 13 is a seventh diagram showing the procedure for the use of the printer of FIG. 1.
Figure 14:
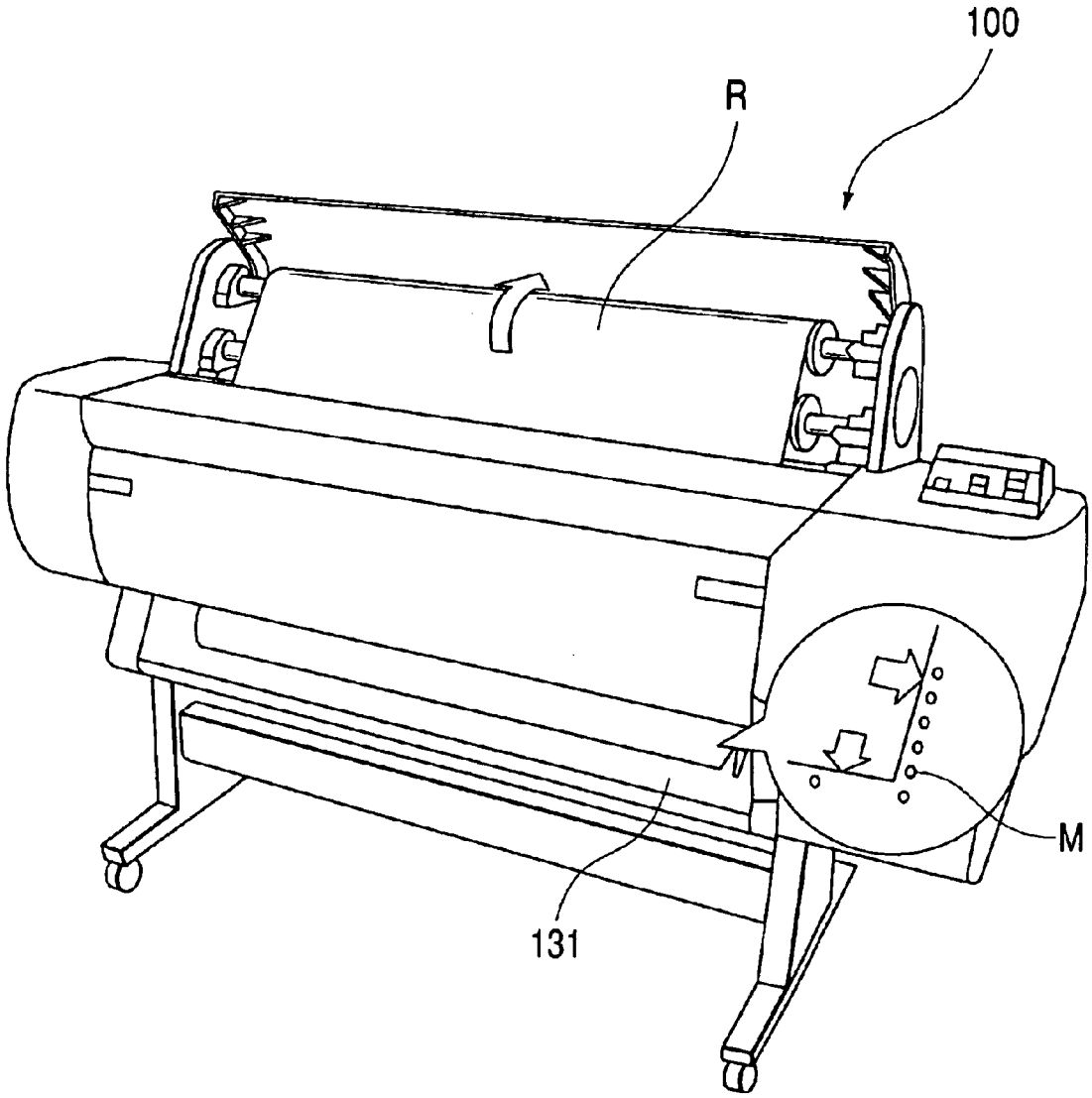
FIG. 14 is an eighth diagram showing the procedure for the use of the printer of FIG. 1.

As shown in FIG. 12, the forward end of the rolled paper R is pulled out downward and passed through the carrier passage of the printing unit 120 and further passed therethrough up to the carrier passage of the discharging unit 130 as shown in FIG. 13. As shown in FIG. 14, the forward end of the rolled paper R is rotated in the direction of winding the rolled paper R and positioned at a marker M formed on the feeder output guide 131. Thereafter, the ink-jet printer 100 is started and ink droplets are caused to be discharged by feeding in the rolled paper R in the subscanning direction and moving the recording head 121 in the main scanning direction.

As set forth above, according to the invention, as the torque is released by the torque transmission limiting portion from being transmitted to the one-way connection portion when torque at the predetermined value or larger is applied to the roll shaft body at the time the rolled recording medium is carried, only the roll shaft body is rotated according to the torque and the rolled recording medium is supplied-sent. Consequently, the rolled recording medium is prevented from making an oblique movement and producing creases.

When the value of the torque applied to the roll shaft body comes to be smaller than the predetermined value as the rolled recording medium is stopped from being carried, the torque is transmitted by the torque transmission limiting portion to the one-way connection portion. Consequently, the rotation of the roll shaft body is braked by the latching portion and the one-way connection portion and quickly stopped. Therefore, the rolled recording medium can be prevented from warping. Moreover, the rolled recording medium can readily be wound manually because the roll shaft body can be subjected to free-load rotation by the one-way connection portion in a direction opposite to the direction of feeding in the rolled recording medium to ensure that the cog misalignment phenomenon of the roll shaft is prevented from occurring.

What is claimed is:

1. A roll shaft hung with a bearing portion of a recording medium supply apparatus for holding a rolled recording medium, wherein the recording medium is fed by rotating the roll shaft together with the recording medium, the roll shaft comprising:

a roll shaft body which is inserted through a core of the rolled recording medium;

a latching portion mounted outside of one end portion of the roll shaft body, being latched with the bearing portion;

a one-way connection portion mounted inside of the one end portion of the roll shaft body, rotatable with respect to the latching portion in only a direction opposite to a direction of feeding in the recording medium; and a torque transmission limiting portion which is mounted inside of the one end portion of the roll shaft body, wherein the torque transmission limiting portion releases a transmission of torque if the torque applied to the roll shaft body is not less than a predetermined value and transmits the torque if the torque is less than the predetermined value when the recording medium is fed.

2. The roll shaft as claimed in claim 1, wherein an outer diameter of the latching portion is smaller than an inner diameter of the core of the rolled recording medium.

3. The roll shaft as claimed in claim 2, wherein the outer diameter of the latching portion is substantially equal to an outer diameter of the roll shaft body.

4. The roll shaft as claimed in claim 1, wherein the one end portion of the roll shaft body where the latching portion and the torque transmission limiting portion are mounted passes through the core of the rolled recording medium, and an abutment member for abutting and stopping the rolled recording medium is provided on another end portion of the roll shaft body.

5. The roll shaft as claimed in claim 1, wherein the latching portion has at least one projection arranged in a circumferential direction of the roll shaft, the at least one projection being latched to the bearing portion.

6. A recording medium supply apparatus for supplying a rolled recording medium, wherein a roll shaft as claimed in claim 1 is mountable.

7. A recording apparatus for conducting recording on a rolled recording medium, including a recording medium supply apparatus as claimed in claim 6.

* * * * *